US007040227B1

(12) United States Patent
Ellison

(10) Patent No.: US 7,040,227 B1
(45) Date of Patent: May 9, 2006

(54) STAMPING DEVICES AND METHODS

(75) Inventor: Thomas M. Ellison, Fort Mill, SC (US)

(73) Assignee: E Innovations, Inc., Fort Mill, SC (US)

( * ) Notice: Subject to any disclaimer, the term of this patent is extended or adjusted under 35 U.S.C. 154(b) by 8 days.

(21) Appl. No.: 10/677,822

(22) Filed: Oct. 1, 2003

Related U.S. Application Data

(60) Provisional application No. 60/415,684, filed on Oct. 2, 2002.

(51) Int. Cl.
*B41F 17/00* (2006.01)

(52) U.S. Cl. ..... 101/372; 101/395; 101/401.1; 283/94

(58) Field of Classification Search ..... 101/333, 101/372, 395, 397, 400, 401.1; 283/91, 94
See application file for complete search history.

(56) References Cited

U.S. PATENT DOCUMENTS 1,118,951 A * 12/1914 Rosenberg ..... 101/400
1,349,720 A * 8/1920 Hollister ..... 101/400
1,990,421 A * 2/1935 Taylor ..... 427/274
3,241,429 A * 3/1966 Leach et al. ..... 359/620
4,033,059 A * 7/1977 Hutton et al. ..... 283/91
4,034,555 A 7/1977 Rosenthal
4,187,772 A * 2/1980 Hollenbeck ..... 101/379
5,228,387 A * 7/1993 Siculan ..... 101/211
5,313,885 A * 5/1994 Winston ..... 101/405
5,468,540 A * 11/1995 Lu ..... 428/156
5,471,930 A * 12/1995 Wood ..... 101/405
6,385,882 B1 5/2002 Conley et al.

* cited by examiner

*Primary Examiner*—Andrew H. Hirshfeld
*Assistant Examiner*—Jill E. Culler
(74) *Attorney, Agent, or Firm*—Bachman & LaPointe, P.C.

(57) ABSTRACT

An adhesive-backed lenticular lens may be applied over an image. The image may be generated by transferring from an ink source to a ink transfer print plate having a regular pattern of raised and recessed areas or may be applied by a stamp having an image formed by raised and recessed areas in a regular pattern.

2 Claims, 4 Drawing Sheets

STAMPING DEVICES AND METHODS

CROSS-REFERENCE TO RELATED APPLICATION

Benefit is claimed of provisional application Ser. No. 60/415,684 filed Oct. 2, 2002.

BACKGROUND OF THE INVENTION (1) Field of the Invention

The invention relates to stamps. More particularly, the invention relates to hand stamping of design elements.

(2) Description of the Related Art

Hand held rubber stamps are used by rubber stamp artists and crafters to print predetermined patterns or designs on various materials used in making hand crafted cards and other art and craft objects. Various layering and embossing techniques are used to add a depth aspect to so called rubber stamp art, but there has not been a way to apply the unique visual qualities of lenticular lens technology to the hand scale required for rubber stamp art. The application of a lenticular lens cover sheet in registry with a hand printed series of spaced image lines in a pattern or design would create exciting new and unique visual features for the rubber stamp artist or crafter.

In a different field, as indicated in U.S. Pat. No. 4,034,555 to Rosenthal, issued Jul. 12, 1977, lenticular lenses are well known for use in optical systems to produce various types of unique optical effects. The known lenticular lens systems generally include a transparent sheet having a plane surface on one side thereof and on the other side, a series of parallel longitudinal ridges which have near-parabolic or circular smooth surfaces creating a multi-lenticular system of convex lenses. A print sheet or medium is generally disposed at the back of the lens adjacent to or on the plain surface. The print sheet contains at least two alternate series of spaced image lines, each series of image lines constituting a dissection or breakup of a master picture. The two series of image lines are so optically related with respect to the lens elements as to be alternately visible upon positional change of the viewer with respect to the lenses. When viewed from one position, the first series of image lines are visible so as to display the first composite picture. When viewed from a second position, the second series of lines are visible so as to display the second composite picture.

Lenticular optical systems have found numerous uses, including toys, pins, and other types of gag devices. More recently, lenticular lenses have been used to enhance advertising displays, packaging, and signs of various types, see, for example, U.S. Pat. No. 6,385,882 to Conley et al., issued May 14, 2002.

Historically, lenticular lens applications have required sophisticated photographic imaging or costly print imaging processes, such as ink jet, lithographic or flexographic printing, to achieve the unique optical displays that are characteristic of lenticular displays.

SUMMARY OF THE INVENTION

One aspect of the invention involves a print transfer plate apparatus. An ink transfer print plate has a number of raised print surfaces separated by depressed non-print surfaces such that the raised print surfaces are equally spaced in one direction and extend elongate in a second direction normal to the one direction. The ink transfer print plate is bonded to a mounting member.

In various implementations, the raised print and depressed non-print surfaces may cover substantially the entire surface of a printing plate. The raised print surfaces may be arranged in a pattern to print a specific design. The raised print surfaces may be a first number equally spaced at a first spacing. The plate may have a second number of raised print surfaces separated by depressed non-print surfaces such that the second raised print surfaces are equally spaced in the one direction and extend elongate in the second direction and are out of phase with the first number of raised printed surfaces. The ink transfer print plate may be so bonded to the mounting member via an intermediate layer of foam polymer cushion material. The ink transfer print plate may be rubber or plastic. The mounting member may be wood, metal, or plastic. The raised print surfaces may be equally spaced at a pitch of between 20 per inch and 100 per inch. The pitch may be between 20 per inch and 80 per inch.

Another aspect of the invention involves an ink transfer print plate having a number of raised print surfaces separated by depressed non-print surfaces such that the raised printed surfaces are equally spaced in one direction and have a surface width in that one direction no more than half a spacing in that one direction.

In various implementations, the width may be at least 10% of the spacing. The width may be 30–40% of the spacing. The raised print surfaces and depressed non-print surfaces may extend continuously in a second direction normal to the first direction.

Another aspect of the invention involves a printing plate transfer apparatus having a mounting block having a number of sides. The first means is mounted to a first side of the block for printing a specific image for having a particular affect when viewed through a lenticular lens. The second means is mounted to a second side of the block for printing a second image, substantially the same or at least partially corresponding to said specific image, while not achieving the particular affect when viewed through the lenticular lens.

In various implementations, the first means may include a first ink transfer print plate having a number of raised print surfaces separated by depressed non-print surfaces such that the raised print surfaces are equally spaced at a first spacing in one direction and arranged in a pattern to print a specific design. The second means may include a second ink transfer print plate shaped to print the specific design but not having raised print surfaces equally spaced at the first spacing.

Another aspect of the invention involves a kit. The kit includes at least one adhesive-backed lenticular lens. The kit includes at least one of: a transfer print plate having a print surface with at least one regular pattern of raised and recessed regions; and a substrate having a surface with at least one regular pattern of markings.

In various implementations, the markings may be at a pitch between 95% and 105% of a pitch of the lens. The raised and recessed regions may be at a pitch essentially the same as the pitch of the lens. The print plate print surface may: be shaped to print a specific image having specific design features; or fill an available area (e.g., a circular or rectangular planform of the plate) without design features so that the print surface can be partially inked in a sub-area corresponding to an image such ad by transferring ink from an image source.

Another aspect of the invention involves a method. An ink image is formed on a surface of a transfer member having a regular pattern of raised and recessed regions. The image is transferred from the transfer member to a substrate. A lenticular lens is secured to the substrate.

In various implementations, the raised and recessed regions are straight and linear and at a fixed pitch. The transfer member may be a hand held stamp and the transfer may be done by hand.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
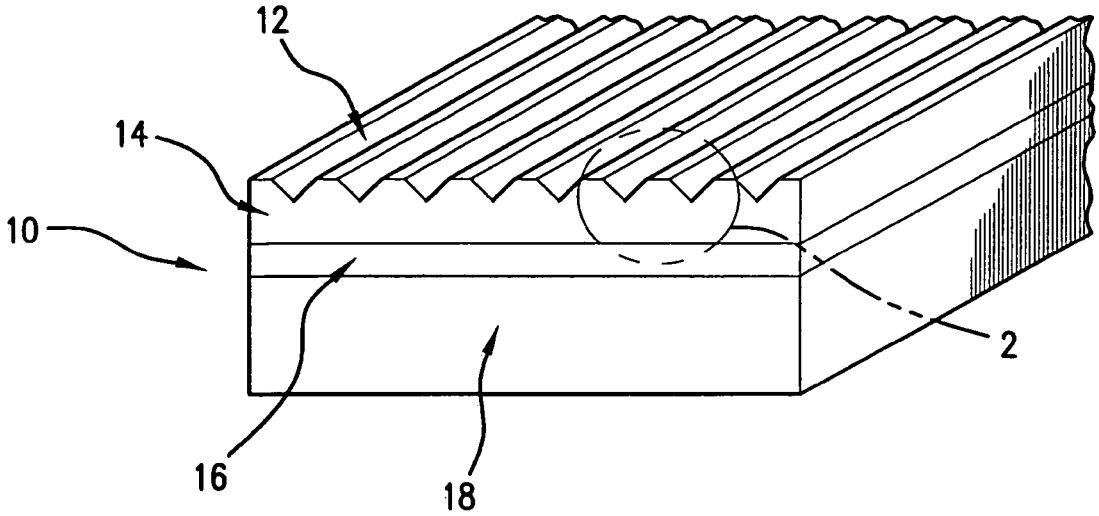
FIG. 1 is a view of ink receptive material of the present invention and packing materials.

FIG. 1 shows the combination 10 of the ink receptive material, an intermediate layer, and a mounting plate. Thus, combination 10 includes print surface 12 of pliable ink receptive material 14, intermediate layer 16, and mounting or holding block 18. The pliable ink receptive material 14 is preferably vulcanized rubber, but may also be any pliable material that will accept ink from an ink pad, dauber or other ink source and transfer the ink to a second surface, such as paper, when pressed against a second surface, as for example, plastics.

The intermediate layer 16 is an optional foam layer that aids the print surface to conform to the surface to be printed, as for example, a polymer foam, cushion material. The mounting or holding block 18 is usually wood, but may be plastic or metal, that holds the structure in a rigid, flat position and provides a handle means for holding the structure by hand.

Figure 2:
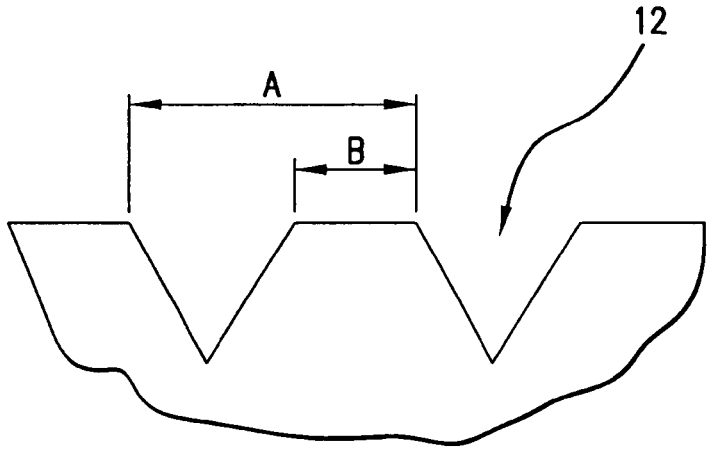
FIG. 2 is a detail of the surface of the ink receptive material of FIG. 1.

FIG. 2 is a detail of surface 12 of the ink receptive material from area 2 of FIG. 1, in enlarged configuration.

Referring to FIG. 2, dimension A is one spaced line of the print transfer surface. Dimension A equals the length of one lenticule cross section in the matching lenticular lens and represents the viewing length that falls under one lenticule. Dimension B ranges from about 10% of dimension A to about 50% of dimension A. When dimension B is between about 10% and about 50%, lines printed with the print surface are visible under a matching (having the same count of print lines or lenticules per linear per inch) lenticular lens at one viewing angle and invisible at another viewing angle. This provides an image that "flips" from "off" (invisible) to "on" (visible) as the lens and printed composite is rotated along an axis that is parallel with the linear direction of the lens. Below about 10%, the ink transfer is insufficient for easy viewing. Above about 50%, the image can be viewed over a wide range of lens rotation and the "flip" effect is lost. The preferred dimension for B is between about 30 and 45% of A.

A lenticular lens is characterized by the lens axis of rotation, the cross-section length of one lenticule, and the lenticule focal distance.

Figure 3:
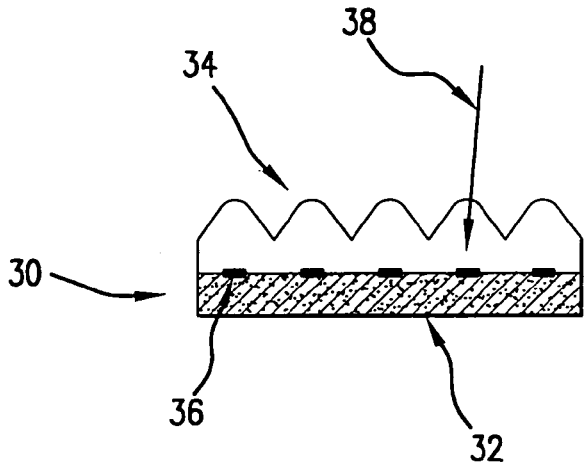
FIG. 3 shows the combination of printed material on lenticular lines at a first viewing angle.
Figure 4:
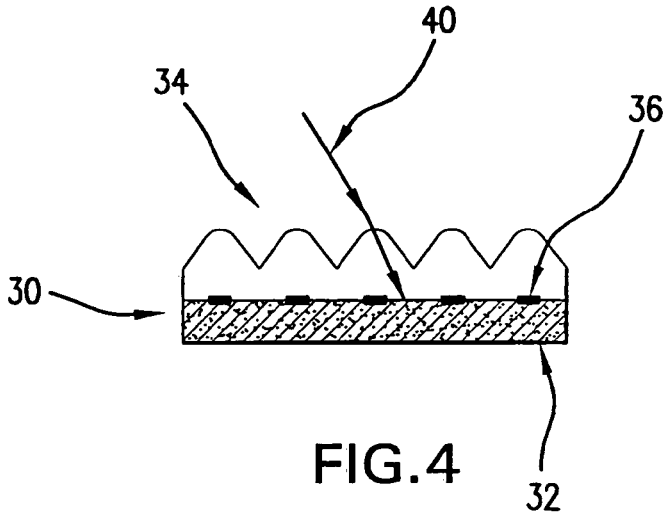
FIG. 4 shows the combination at a second viewing angle.

FIGS. 3 and 4 shows the combination 30 of printed material 32 and lenticular lens 34, with printed image 36 therebetween. FIGS. 3 and 4 show different viewing angles, with FIG. 3 showing viewing angle 38 with image visible, and FIG. 4 showing viewing angle 40, with image invisible.

The larger the lenticules the easier it is to align the printed lines with the lens. To maintain the focal distance for a lenticule, the lens sheet thickness must increase as the lenticule size increases. Thicker sheets are more difficult to cut using the tools, such as scissors, normally used in hand art. Also, larger lenticules become objectionable in appearance when the lens count gets below about 20 lines per inch. These factors make a practical lower limit for the print line count (and corresponding lenticule count) of about 20 lines per inch. The practical limit on the other end of the scale is about 110 lines per inch. Above this value, it becomes increasingly difficult to hand align the lens sheet with the printed line pattern. The preferred range is from about 30 lines per inch to about 80 lines per inch.

Figure 5:
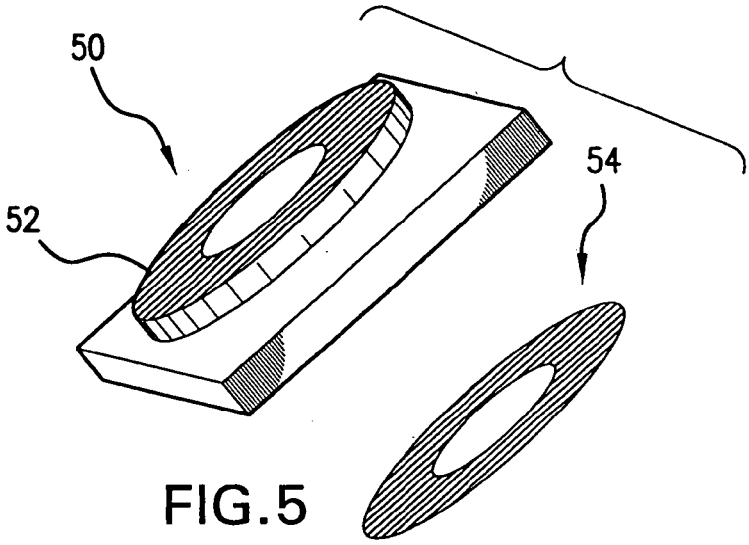
FIG. 5 shows a stamp and print design in bas-relief.

In the practice of this invention, a transfer method may be used. A conventional rubber stamp having a predetermined print design molded in bas-relief on the print surface is inked by conventional means known to those skilled in the art of rubber stamping. The conventional stamp is then pressed against the lined stamp shown in FIG. 1 and a substantial portion of the ink is transferred to the lined stamp. The lined stamp is then pressed against the material to be printed, typically paper or paper board. The lenticular lens sheet is then aligned with the printed ink pattern and bonded to the printed surface. Bonding may be by a pressure sensitive adhesive pre-applied to the lens sheet or by the use of adhesives used routinely in the art of layering paper and card stock. Alternatively, the lined print surface may be inked over a substantial area. A conventional stamp may then be pressed against the lined print surface to transfer the lined pattern to the design molded in bas-relief on the conventional stamp. This image may now be transferred to paper or other desired surface, the lens sheet aligned and bonded to create the desired flip image affect. Multiple images may be created in one ink transfer by inking several conventional stamps pressing them against different locations on a lined stamp for transfer to paper. While a "master" lined stamp is described above for ink transfer with a conventional stamp, other embodiments are envisioned. For example, a lined stamp may be carved, as is practiced in the rubber stamp art, to remove material in areas that are not to be printed. The result is a print design in bas-relief that has the lined pattern in the design. FIG. 5 shows a carved or molded stamp 50 in relief, with lines 52 showing the print surface, and 54 showing the printed design. This stamp can be inked and printed directly to paper or other desired surface without the transfer step. In a further embodiment, a desired design can be etched in a magnesium plate along with the lined pattern. A negative of the magnesium plate may be formed as above. Rubber can then be pressed into the negative and heated to make a direct print stamp having the features of this invention.

The present invention will be more clearly understood from a consideration of the following illustrative examples.

EXAMPLE 1

In a first experiment, a lenticular lens sheet was used as the lined printing surface. The tops of the lenticules were abraded to improve ink receptivity. The abraded surface was then inked and pressed against a paper surface. Lines printed with this print surface could be readily aligned with a corresponding lenticular lens sheet. The results demonstrated the ability to use a hand held device to create the visual attributes of a lenticular lens/print system. As a print surface, the abraded lens ink receptivity was only fair and, due to stiffness, the lens lacked good conformity to surfaces to be printed. The resulting printed lines were narrow and lacked good visibility.

EXAMPLE 2

In a second experiment, a vinyl print surface was made by casting a vinyl latex onto the surface of a lenticular lens sheet. In this manner, the negative of the lenticular surface was replicated. Using this surface resulted in improved conformity for the print surface and alignment with the lenticular lens overlay was excellent. However, as in the above example, the printed lines were narrow and had poor visibility.

EXAMPLE 3

In a third example, a magnesium plate was etched with a lined pattern having a line count of 60 lines per inch to register with a 60 lpi lens sheet. The width of the lines was selected to be about 35% of the dimension "A" in FIG. 2. An uncured high pressure laminate on bakelite board was molded with heat and pressure against the magnesium master to create a mold board. Conventional un-vulcanized rubber, as used in the art to make rubber printing stamps, was pressed against the mold board and heated to vulcanize the rubber. The rubber printing plate was then mounted on wood to make a hand held stamp. This stamp had excellent conformability to the surfaces to be printed and excellent ink receptivity but the expected alignment correlation with the 60 lpi lens sheet was not achieved and "flip" images were not achieved. It was determined that the slight 2% shrinkage that occurs in the rubber as it vulcanizes is sufficient to cause misalignment between the resulting print and the selected lens. The process was repeated, taking into account the 2% rubber shrinkage when the lined pattern was etched into the magnesium plate. The rubber stamp made from this plate gave the desired conformability, ink transfer and angular alignment and position registration with the lenticular lens sheet and good flip images were provided. Slight variation in the line count on the stamp compared to the lens still has value for visual effect even though flip images are not possible. In this situation, image lines or bars are created by the interaction of the lens and the print. The visual angle of the bars depends on the degree of angular alignment of the lines of the print and the lens.

Figure 6:
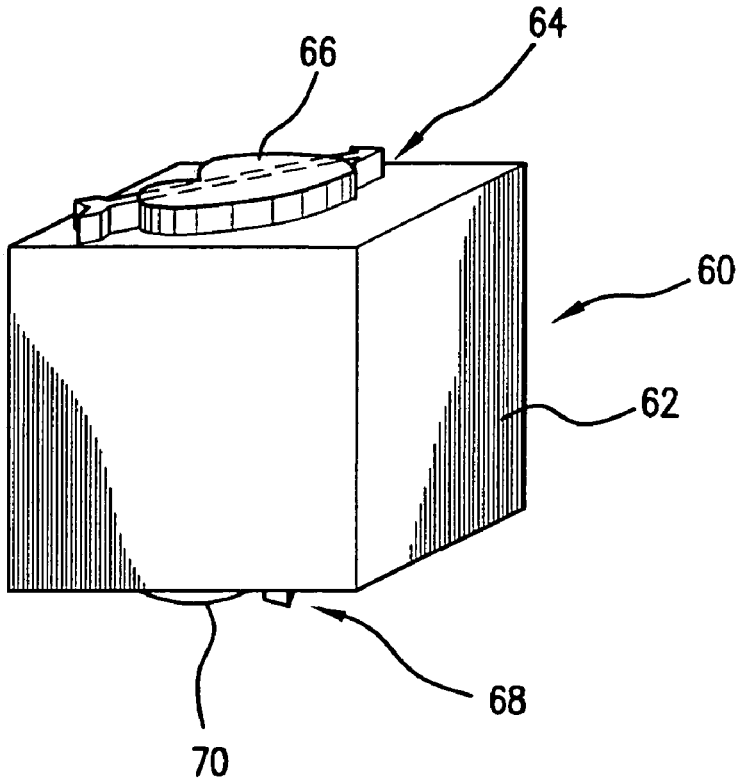
FIG. 6 shows a first alternate printing apparatus.

The foregoing fabrication techniques may be applied to wide variety of printing devices used in a variety of methods. One family of such devices and methods involves the printing of multiple graphically-similar images (e.g., images of similar shape, size, and internal design features) on a given substrate wherein the images have different effects when viewed through the lenticular lens. One situation involves the printing of two similar images of which one has no lenticular affect. FIG. 6 shows a printing apparatus 60 having a mounting block 62 (e.g., as a right parallelepiped having six sides). One side of the block bears a first image printing means 64 such as a combination of an aforementioned ink-receptive material layer and intermediate layer, with the outboard surface 66 of the ink-receptive material layer being shaped to form a design from the alternating raised and recessed areas. On another side of the block (e.g., the opposite side) a second means 68 is provided having a similar shape (both its outer periphery and any internal features) but whose outboard surface 70 lacks the linear recessed areas except to the extent that any such area might be a portion of the design. The user may ink the first means and print a number of lined images on a substrate (e.g., paper). The user may also ink the second means and produce similar unlined images. When viewed through the lenticular lens, the lined images will appear and disappear whereas the unlined images will remain approximately constant. In yet further variations, the second side or one of the other sides may have a third printing means for printing an alternate lined image. This printing means may be positioned slightly differently relative to the surface of the block. For example, relative to the first means, it may be shifted by some fraction (e.g., 50%) of the line spacing relative to an adjacent edge of the block. If the edge associated with the first means is used to register the block when printing with the first means and the edge associated with the third means is used to register the block when printing with the third means, the images produced by the first means and images produced by the third means will be in some form alternately viewable depending on the viewing angle.

Figure 7:
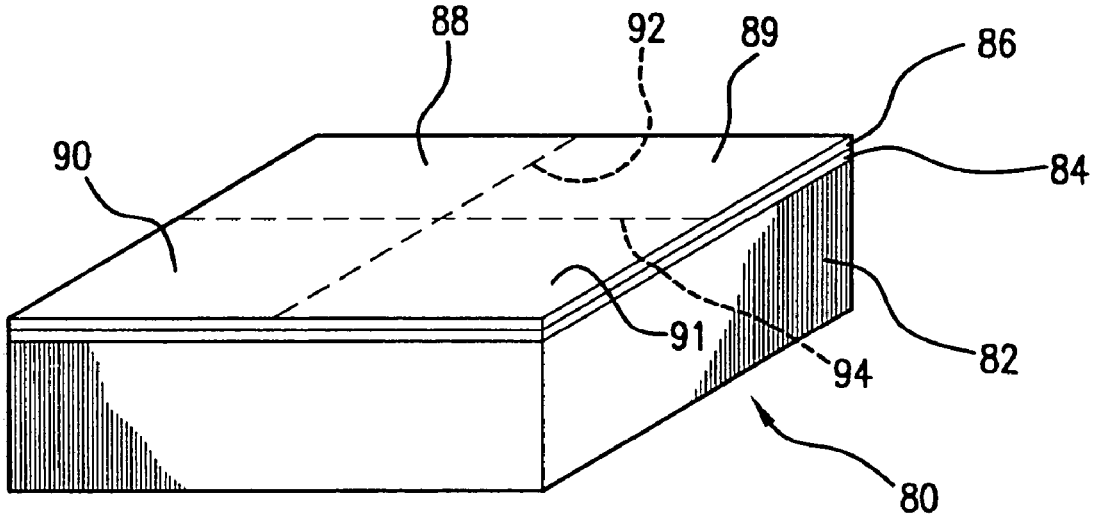
FIG. 7 shows a second alternate printing apparatus.

FIG. 7 shows yet another apparatus for printing images whose lines may be out of registration with each other. The apparatus 80 includes a mounting plate 82, intermediate layer 84, and ink-receptive material layer 86. The print surface of the layer 86 is divided into regions 88, 89, 90, and 91 along boundaries 92 and 94. In an exemplary embodiment, the printing surface on each of the regions has linear printing and recessed areas at the same spacing but slightly out of phase amongst the various regions. Accordingly, ink from an unlined image source can be applied to the different areas and printed to the substrate simultaneously. The same source may be used for the different portions or different sources may be used or any combination thereof. With the lens applied to the substrate, the images associated with the different portions will be viewable from different angles. In a more complex method, the block may be repeatedly used to apply images to the substrate. The block region chosen for a given image may be associated with the desired viewing angle. The block may be repeatedly registered with some reference on the substrate, a fixture holding the substrate, or something else, to ensure proper registration of the lines of the various images.

Figure 8:
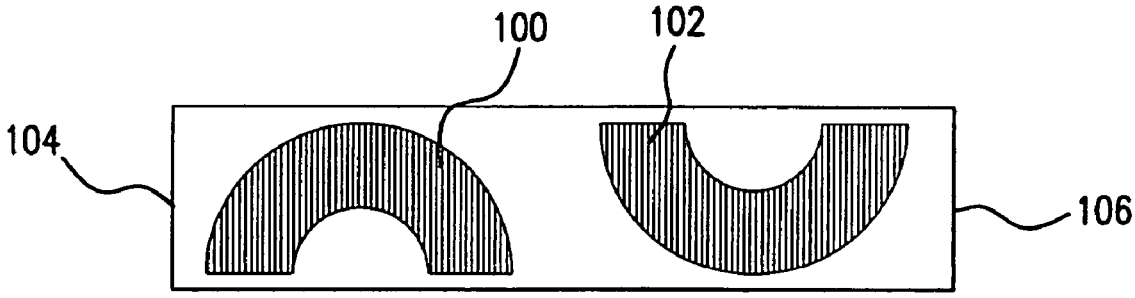
FIG. 8 shows a third alternate printing apparatus.

FIG. 8 shows a printing surface of a plate having regions 100 and 102 for printing a pair of images, each formed of linear raised and recessed areas. The images are of overall similar shape. The raised areas of the region 100 have a certain relationship to the adjacent side 104 of the block. The raised areas of the region 102 bear a slightly different relationship (e.g., phase relationship) to the adjacent side 106. Thus when the associated block side is registered to a common linear reference, print images from the respective printing regions 100 and 102 will have their printed lines out of phase. Thus the two printed images will be visible at different viewing angles. Alternatively, as noted above with respect to FIG. 6, the images could be somewhat different in overall plan layout or shape. For example, in either of these embodiments one different image could be a bird with its wings elevated while another could be a bird with its wings lowered. When two such adjacent printed images are out of phase, a change of viewing angle can produce the illusion that there is one image that has both changed and moved (the exemplary change being a flapping of the wings). The image portion corresponding to the bird's head, breast, and tail could be the same in both images. Similarly, one of the images may be unlined in either embodiment. Also the printed images may be overlayed. For example, an unlined image could be a closed eye and a lined image could be an open eye. In an overlay situation, the unlined image might be printed in light ink and the lined image printed thereatop in dark ink. When viewed through the lenticular lens, when the lined image is invisible the user will see the unlined image. When the lined image is visible, its relative darkness will tend to overwhelm the unlined image. Thus in the example, a change of viewpoint could create the illusion of winking. The image portion corresponding to the eye outline and lower lashes could be the same in both images.

A further visual feature of a dimensional effect can be achieved by printing solid images over the spaced apart background lines followed by over-laminating a lens sheet. The lens sheet and the background lines are slightly misregistered and/or angularly misaligned. The misregistration/misalignment creates image bars as a result of interaction between the lenticules and the background lines. Printed images will appear to be in front of the bars when the background lines are slightly higher in line count than the lens lenticule count. Printed images will appear to be behind the bars when the background line count is slightly lower than the lens lenticule count. In both cases, the bars will appear to move as the composite print and lens is rotated about the axis parallel to the lenticular lens axis. This is similar to the visual effect described in U.S. Pat. No. 6,385,882, referred to hereinabove. With the foregoing in mind, a variety of options exist for the packaging of kits. One area of kits would include a sheet of adhesive backed lenticular lens material (with appropriate peel away sheet over the adhesive). Such kit could further include one or more of the foregoing stamps whose raised and recessed area are at the same pitch as the elements of the lens. The kit could include various substrate materials having printed and unprinted areas in lien of the raised and recessed areas of the stamp. For example, sticker/decal material could allow the user to cut a desired shape which might otherwise be similar to the shape of the stamped image. Such substrate material could, alternatively, be preformed in such shapes. Such substrate material could, in turn, be placed on further substrate material such as clean paper, cardstock, or the like. Such substrate material could be placed on further lined or pattern substrate material. For example, the kit could include paper or cardstock lined at a slightly different pitch than the lens. To provide the foregoing depth affect. Such off-pitch substrate could receive solid (e.g., unlined) stampings, drawings, decaling/stickering, or the like. Such off-pitch substrate could, alternatively, receive on-pitch stamping, etc.

Figure 9:
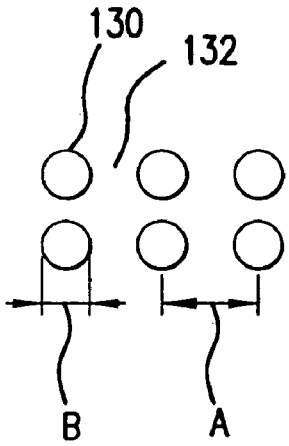
FIGS. 9–11 show alternate arrangements of raised and recessed areas for an ink receptive material.
Figure 10:
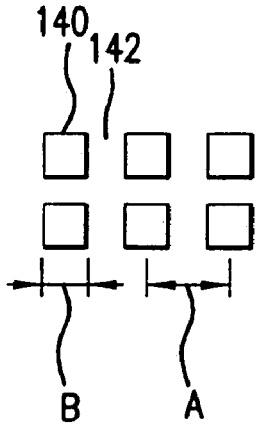
Figure 11:
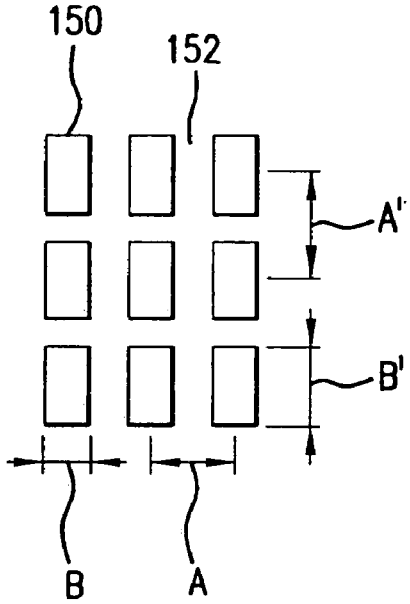

Although the raised areas may be continuous linear arrays, they may be discontinuous as in an array of raised areas. FIG. 9 shows an array of circular raised areas 130 separated by recessed areas 132. The raised areas are arranged in rows spaced apart from each other at an on-center spacing A and having a width B in the direction of spacing. The rows extend normal to the direction of spacing. There may be a similar spacing in the direction of extension. FIG. 10 shows an alternate array of square raised areas 140 separated by recessed areas 142. FIG. 11 shows rectangular raised areas 150 separated by recessed areas 152. In the second direction, the raised areas have a length B' and a spacing A'. In the exemplary embodiment, the raised areas 150 are elongate in the second direction (i.e., B'>B).

One or more embodiments of the present invention have been described. Nevertheless, it will be understood that various modifications may be made without departing from the spirit and scope of the invention. For example, various stamping techniques may be used as may various substrates. Additionally, further graphic devices may be included in appropriate combinations. Accordingly, other embodiments are within the scope of the following claims.

What is claimed is:

1. A printing transfer plate apparatus comprising:

a mounting block having a plurality of sides;

a first ink transfer print plate bonded to a first of said sides and having a plurality of raised print surfaces separated by depressed non-print surfaces such that the plurality of raised print surfaces are equally spaced at pitch of between 20 per inch and 100 per inch in one direction and extend elongate in a second direction normal to said one direction, the plurality of raised print surfaces of the first ink transfer print plate being configured for printing a specific image for achieving a particular effect when viewed through a lenticular lens; and a second ink transfer print plate mounted to a second of the plurality of sides and having a plurality of raised print surfaces of the second ink transfer print plate are configured for printing a second image, at least partially corresponding to said specific image, for not achieving said particular effect when viewed through said lenticular lens.

2. The apparatus of claim 1 wherein:

the second image is unlined.

* * * * *